US010617175B2

(12) United States Patent
Gilmore

(10) Patent No.: US 10,617,175 B2
(45) Date of Patent: Apr. 14, 2020

(54) SPRAIN ARRESTOR

(71) Applicant: William Demetrius Gilmore, Tallahassee, FL (US)

(72) Inventor: William Demetrius Gilmore, Tallahassee, FL (US)

( * ) Notice: Subject to any disclaimer, the term of this patent is extended or adjusted under 35 U.S.C. 154(b) by 95 days.

(21) Appl. No.: 15/854,005

(22) Filed: Dec. 26, 2017

(65) Prior Publication Data

US 2019/0191819 A1 Jun. 27, 2019

(51) Int. Cl.
*A43B 17/02* (2006.01)
*A43B 7/24* (2006.01)
*A43B 7/14* (2006.01)

(52) U.S. Cl.
CPC ..... *A43B 17/023* (2013.01); *A43B 7/142* (2013.01); *A43B 7/24* (2013.01); *A43B 7/141* (2013.01)

(58) Field of Classification Search
CPC ..... A43B 17/023; A43B 7/142; A43B 7/24; A43B 7/141; A43B 13/383; A43B 13/386; A43B 13/40; A43B 13/42; A43B 17/006; A43B 17/14; A43B 17/02
USPC ..... 36/43, 44
See application file for complete search history.

(56) References Cited

U.S. PATENT DOCUMENTS

2002/0162250 A1* 11/2002 Campbell ..... A43B 7/141 36/166
2004/0103561 A1* 6/2004 Campbell ..... A43B 7/141 36/88
2004/0194348 A1* 10/2004 Campbell ..... A43B 7/142 36/93
2007/0084084 A1* 4/2007 Rich ..... A43B 7/142 36/44
2007/0261268 A1* 11/2007 Nguyen ..... A43B 7/147 36/44
2009/0094861 A1* 4/2009 Orvitz ..... A43B 1/0081 36/91
2009/0320329 A1* 12/2009 Darby, II ..... A43B 7/00 36/140
2017/0258175 A1* 9/2017 Li ..... A43B 3/0078

* cited by examiner

*Primary Examiner* — Justin M Jonaitis
(74) *Attorney, Agent, or Firm* — Ballard Spahr LLP

(57) ABSTRACT

The Sprain Arrestor is an orthotic wedge made of cut and shaped industry standard multidurometer tri-laminate material which by its size and shape and placement inside the shoe offers an inexpensive alternative to bulky bracing and or elastic minimally supportive bandages and wrappings which can restrict circulation. Its use is totally dependent upon the need of the user.

18 Claims, 3 Drawing Sheets

SPRAIN ARRESTOR

BACKGROUND

The Sprain Arrestor is a lateral orthotic wedge. Without wishing to be bound by theory, the Sprain Arrestor can be useful in treating ankle instability due to traumatic injuries to the ankle, as well as malformations of the foot. The Sprain Arrestor can also provide an inexpensive alternative to ankle supports and offer protection for individuals who may be prone to ankle inversion.

SUMMARY

Without wishing to be bound by theory, the Sprain Arrestor is an inexpensive orthotic appliance that can beneficially serve individuals, while eliminating the more expensive costs of professional medical services and avoiding the use of bulky, restrictive orthotic appliances such as braces and other constricting bandage supports. In addition, the Sprain Arrestor can be worn inside the shoe where it is unseen.

DESCRIPTION

Figure 1:
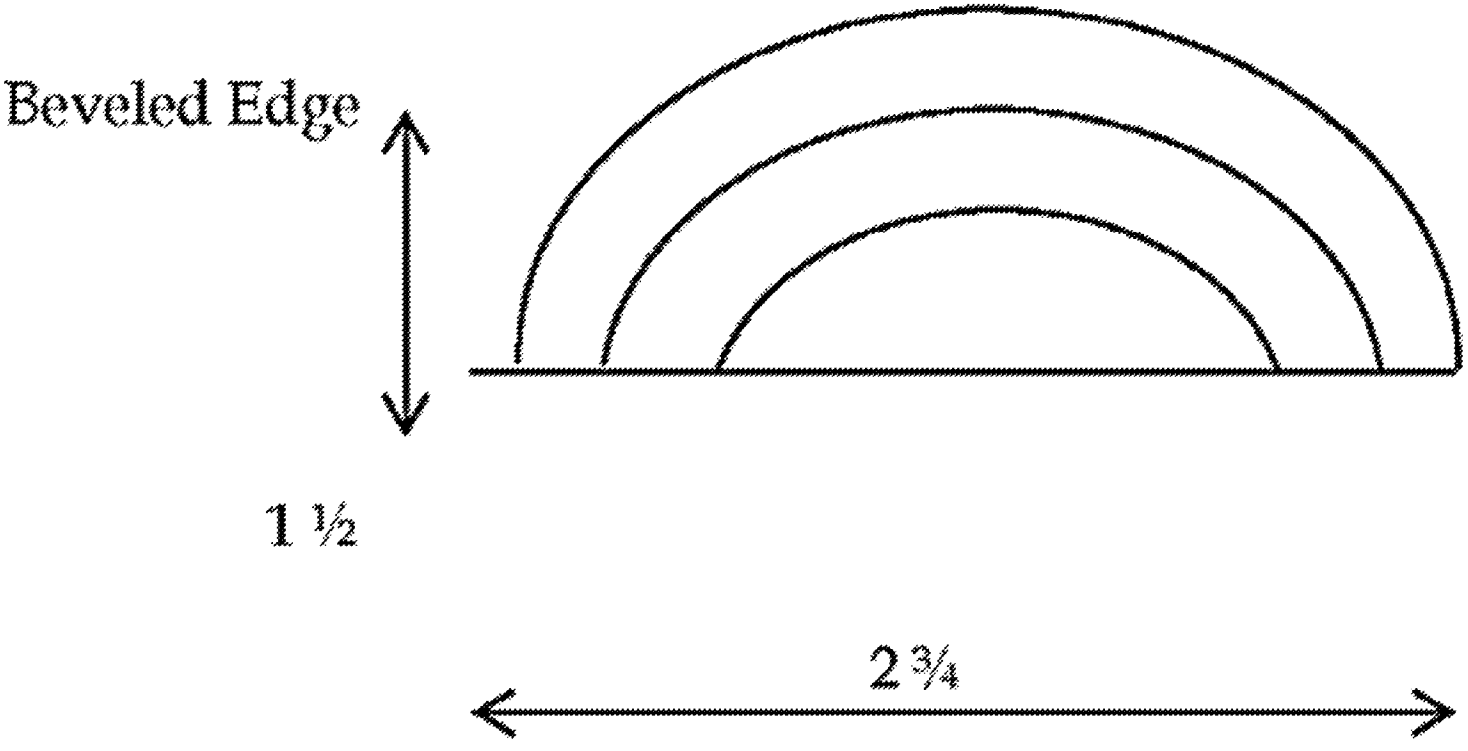
FIG. 1 shows a representative top view of a Sprain Arrestor, depicting a representative size and shape of the tri-laminate layers composed of industry standard orthopedic multi-durometer tri-laminate layers of ethylene-vinyl acetate (EVA), Poron® (urethane foam), and Plastazote® (medical grade foam).
Figure 2:
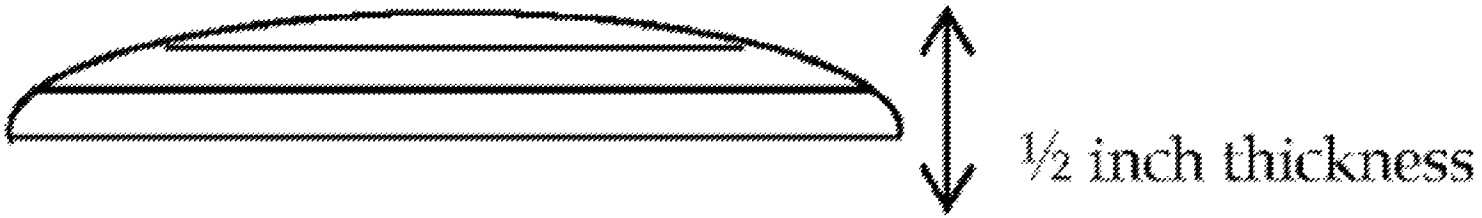
FIG. 2 shows a representative rear view of a Sprain Arrestor, depicting a representative size and shape of the tri-laminate layers composed of industry standard orthopedic multi-durometer tri-laminate layers of ethylene-vinyl acetate (EVA), Poron® (urethane foam), and Plastazote® (medical grade foam).
Figure 3:
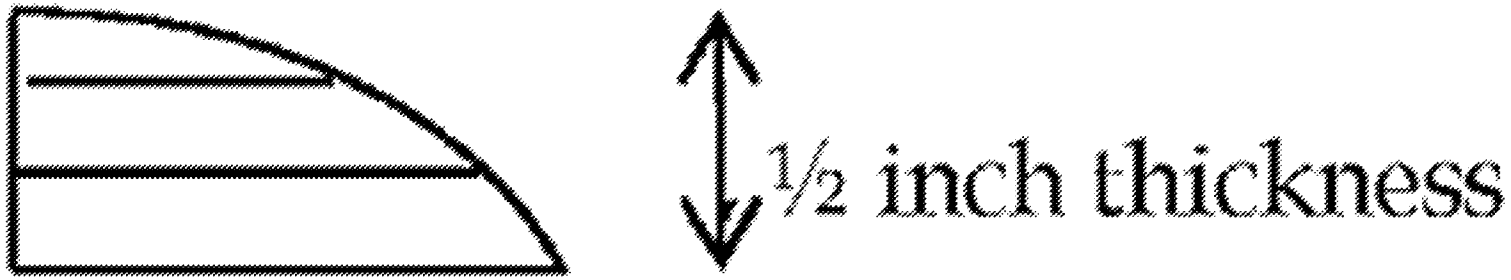
FIG. 3 shows a representative side view of a Sprain Arrestor, depicting a representative size and shape of the tri-laminate layers composed of industry standard orthopedic multi-durometer tri-laminate layers of ethylene-vinyl acetate (EVA), Poron® (urethane foam), and Plastazote® (medical grade foam).

The Sprain Arrestor is an orthotic lateral wedge and can have dimensions based upon the Fibonacci curve. The wedge can be made, for example, via cutting and shaping industry standard orthopedic multi-durometer tri-laminate material. The size and shape of the Sprain Arrestor is such that, when placed inside of a shoe, it supports the soft tissue area of the wearer's foot. In particular, the wedge supports the area where the abductor digiti minimi, the peroneous longus tendon, and the inferior peronal trinaculum attach to form the transverse arch and medial longitudinal arch, between the calcaneus, beneath the cuboid bone, and behind the fifth metarsal. Without wishing to be bound by theory, the placement of the Sprain Arrestor inside the shoe (with the curved beveled edge facing inward and the back straight edge facing outward against the inside medial edge of the shoe) will add support to the soft tissue area of the foot and prevent the foot from inverting.

The invention claimed is:

1. An orthotic wedge comprising:

three multi-durometer layers and bounded by a top surface, a bottom surface, and a back surface;

wherein the top surface is formed by a top portion of all three multi-durometer layers and is bounded by the back surface at a top edge and by the bottom surface at an outer edge;

wherein each of the top edge and the outer edge are arc-shaped;

wherein the bottom surface formed by only one multi-durometer layer, is bounded by the top surface at the outer edge and by the back surface at a bottom edge, has a semi-ellipsoid cross-section, and is substantially perpendicular to the back surface; and wherein the bottom edge is substantially linear;

wherein the back surface is formed by a back surface of all three multi-durometer layers, is bounded by the top surface at the top edge and by the bottom surface at the bottom edge, and has a semi-ellipsoid cross-section;

wherein the orthotic wedge has a quarter-ellipsoid cross-section in a z-plane relative to the bottom surface and the back surface; and wherein the orthotic wedge is sized to fit inside a shoe while still allowing room for a wearer's foot.

2. The orthotic wedge of claim 1, wherein the top surface extends to a maximum distance of ½ inch from the bottom surface.

3. The orthotic wedge of claim 1, wherein the top surface extends to a maximum distance of 1½ inches from the back surface.

4. The orthotic wedge of claim 1, wherein the top edge extends to a maximum distance of ½ inch from the bottom surface.

5. The orthotic wedge of claim 1, wherein the outer edge extends to a maximum distance of 1½ inches from the back surface.

6. The orthotic wedge of claim 1, wherein the bottom surface extends to a maximum distance of 1½ inches from the bottom edge.

7. The orthotic wedge of claim 1, wherein the bottom edge has a length of 2¾ inches.

8. The orthotic wedge of claim 1, wherein the back surface extends to a maximum distance of ½ inch from the bottom edge.

9. The orthotic wedge of claim 1, wherein at least one of the multi-durometer layers comprise a medical grade foam.

10. The orthotic wedge of claim 1, wherein each of the multi-durometer layers comprise a medical grade foam.

11. The orthotic wedge of claim 10, wherein the medical grade foam is selected from an ethylene vinyl acetate (EVA) foam, a polyurethane foam, and a polyethylene foam.

12. The orthotic wedge of claim 1, wherein each multi-durometer layer has a different thickness.

13. The orthotic wedge of claim 12, wherein the thickness of the multi-durometer layers is selected from ⅛ inch, 1/16 inch, and ¼ inch.

14. The orthotic wedge of claim 1, wherein the multi-durometer layers comprise:

(a) a first layer of EVA foam, wherein the first layer has a thickness of ⅛ inch;

(b) a second layer of polyurethane foam, wherein the second layer has a thickness of 1/16 inch; and (c) a third layer of polyethylene foam, wherein the third layer has a thickness oft/inch.

15. A kit comprising the orthotic wedge of claim 1 and a shoe.

16. An orthotic wedge comprising:

three multi-durometer layers and bounded by a top surface, a bottom surface, and a back surface;

wherein each of the multi-durometer layers comprise a medical grade foam, and wherein each multi-durometer layer has a different thickness;

wherein the top surface is formed by a top surface of all three multi-durometer layers, is bounded by the back surface at a top edge and by the bottom surface at an outer edge, extends to a maximum distance of 1½ inches from the back surface, and extends to a maximum distance of ½ inch from the bottom surface;

wherein each of the top edge and the outer edge are arc-shaped;

wherein the top edge extends to a maximum distance of ½ inch from the bottom surface; and wherein the outer edge extends to a maximum distance of 1½ inches from the back surface;

wherein the bottom surface is formed from only one multi-durometer layer, is bounded by the top surface at the outer edge and by the back surface at a bottom edge, has a semi-ellipsoid cross-section, is substantially perpendicular to the back surface, and extends to a maximum distance of 1½ inches from the bottom edge;

wherein the bottom edge is substantially linear; and wherein the bottom edge has a length of 2¾ inches; and wherein the back surface is formed from a back surface of all three multi-durometer layers, is bounded by the top surface at the top edge and by the bottom surface at the bottom edge, has a semi-ellipsoid cross-section, and extends to a maximum distance of ½ inch from the bottom edge;

wherein the orthotic wedge has a quarter-ellipsoid cross-section in a z-plane relative to the bottom surface and the back surface; and wherein the orthotic wedge is sized to fit inside a shoe while still allowing room for a wearer's foot.

17. The orthotic wedge of claim 16, wherein the multi-durometer layers comprise:

(a) a first layer of EVA foam, wherein the first layer has a thickness of ⅛ inch;

(b) a second layer of polyurethane foam, wherein the second layer has a thickness of 1/16 inch; and (c) a third layer of polyethylene foam, wherein the third layer has a thickness oft/inch.

18. A kit comprising the orthotic wedge of claim 17 and a shoe.

* * * * *